United States Patent [19]

Witten

[11] 4,436,488

[45] Mar. 13, 1984

[54] BELOW MOTOR PRESSURE COMPENSATION SYSTEM FOR SUBMERSIBLE PUMP

[75] Inventor: Raymond L. Witten, Tulsa, Okla.

[73] Assignee: Hughes Tool Company, Houston, Tex.

[21] Appl. No.: 267,224

[22] Filed: May 26, 1981

[51] Int. Cl.[3] ..... F04B 35/04; H02K 5/12

[52] U.S. Cl. ..... 417/53; 417/414; 310/87

[58] Field of Search ..... 417/424, 358, 414, 53; 310/87

[56] References Cited

U.S. PATENT DOCUMENTS

| | | | |
|---|---|---|---|
| 862,867 | 8/1907 | Eggleston | 417/472 X |
| 2,002,915 | 5/1935 | Mendenhall et al. | 310/87 |
| 2,682,229 | 6/1954 | Luenberger | 417/414 |
| 2,854,595 | 9/1958 | Arutunoff | 417/366 |
| 2,974,240 | 3/1961 | Arutunoff | 310/87 |
| 3,072,810 | 1/1963 | Luenberger | 310/87 |
| 4,230,382 | 8/1980 | Mandell | 310/87 |

*Primary Examiner*—Richard E. Gluck
*Assistant Examiner*—Peter M. Cuomo
*Attorney, Agent, or Firm*—Robert A. Felsman; James E. Bradley

[57] ABSTRACT

A submersible pump assembly has pressure compensator features to avoid negative pressure at the top of the tool during installation. The submersible pump assembly has an electric motor contained within a lubricant filled motor chamber below a pump. A pressure compensator chamber is located below the motor chamber and separated by a partition. The pressure compensator chamber is also filled with lubricant. A passage bypasses the partition and leads to the motor chamber above the motor. A bellows is mounted in the pressure compensator chamber with its mouth facing upwardly. A port extends from the exterior of the pressure compensator chamber to the interior of the bellows for admitting well fluid. Also, the bellows may be filled with a heavy fluid during installation so as to retard contraction of the bellows if the tool is suddenly jerked to a stop. The bypass passage is not required in this embodiment.

2 Claims, 2 Drawing Figures

BELOW MOTOR PRESSURE COMPENSATION SYSTEM FOR SUBMERSIBLE PUMP

BRIEF DESCRIPTION OF THE INVENTION

This invention relates in general to submersible pumps, and in particular to a submersible pump pressure compensating system located below the motor and having features to avoid negative pressure during installation.

This application deals with submersible pumps for use in high volume wells, such as oil wells. The downhole portion of the pump assembly includes a large electric motor with a shaft that extends through a seal section for rotating a centrifugal pump. The seal section and the portion of the housing that contains the motor are filled with a lubricating oil.

It is very important to avoid leakage of water into the motor section, since the water found in oil wells often has a low resistivity. To reduce the pressure differential across the seals in the seal section, and thus reduce the opportunity for leakage, a pressure compensating system is used. The pressure compensating system reduces the pressure differential, preferably equalizing, between the lubricant in the housing and the well fluid. The pressure compensator system also accommodates thermal expansion of the lubricant which occurs because of the heat generated during the operation.

Some pressure compensator systems utilize a rubber bag or diaphragm in the seal section. The interior of the bag is filled with lubricant which communicates with lubricant in the seal section and motor section. The exterior of the bag is exposed to well fluid for equalizing pressure. One disadvantage of this type is that provisions have to be made to allow the shaft to pass through the center of the bag. Also, if the bag is ruptured, the well fluid may migrate downward to the motor section since the well fluid normally has a specific gravity greater than the lubricant.

Another type utilizes a diaphragm or bellows below the motor. One disadvantage of this arrangement occurs during installation of the pump. When the pump assembly is being lowered into the well, if the downward movement is brought to a sudden stop, the momentum will cause lubricant in the motor section to rush downward. Since the motor section is fairly long, up to 60 feet or so, there is a considerable amount of lubricant. The downward flow of lubricant will cause the bellows to rapidly extend, rapidly increasing the volume of the bellows. This may result in drawing a void or causing negative pressure at the top of the seal section. The negative pressure could draw in well fluid past the seals in the seal section.

SUMMARY OF THE INVENTION

The submersible pump assembly of this invention has features to avoid negative pressure at the top of the seal motor section should the pump assembly be rapidly decelerated while lowering into the well. The pump assembly has a pressure compensator chamber that is located below the motor chamber and separated by a partition. A passage bypasses the partition and extends to a point above the motor for communicating lubricant in the motor chamber with the pressure compensator chamber. A bellows with expansible, folded sidewalls and a closed bottom is mounted in the pressure compensator chamber with its open mouth facing upwardly. The interior of the bellows is exposed to well fluid, while the exterior is exposed to lubricant in the pressure compensator chamber.

Also, the bellows may be weighted so that it exerts a downward force equal to the weight of the lubricant above the bypass passage under atmospheric pressure. This causes a balancing of the contraction and extending forces on the bellows when jerked to a stop.

DESCRIPTION OF THE PREFERRED EMBODIMENT

Figure 1:
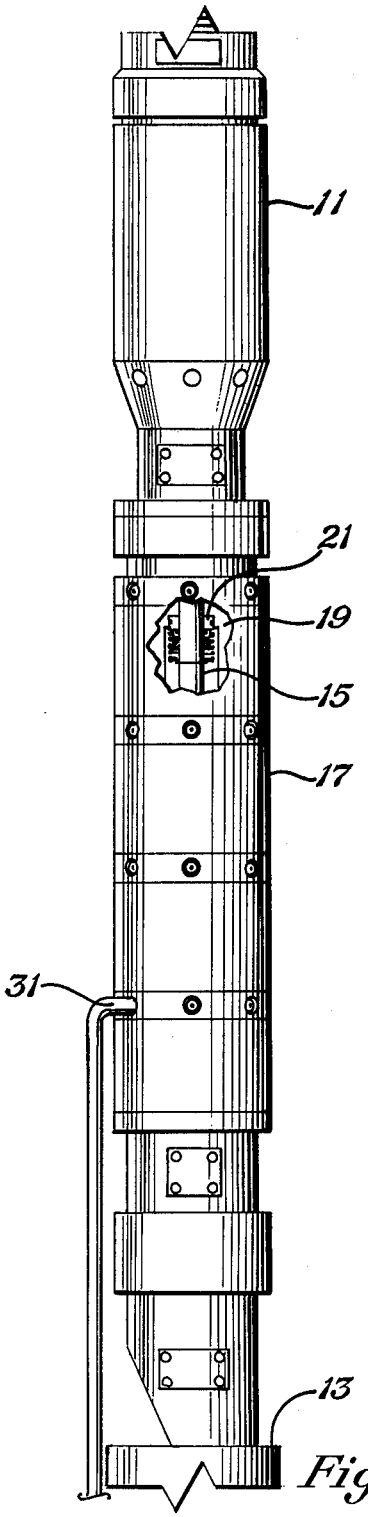
FIG. 1 is a side view, partially in section of a submersible pump assembly constructed in accordance with this invention.

Referring to FIG. 1, the downhole portion of a submersible pump includes a centrifugal pump 11 mounted to the top of a tubular housing. The housing includes a motor chamber 13 and seal section 17. An electric motor 18, located in motor chamber 13, has a shaft 15 that extends upwardly through seal section 17 for rotating pump 11. The motor is conventional, having a rotor 20 that rotates inside a stationary stator 22.

Seal section 17 has a plurality of separate seal chambers 19. Each seal chamber 19 has a seal 21 that seals around shaft 15 for preventing well fluid from leaking downward. Each seal chamber 19 has a U-tube arrangement (not shown) that provides fluid communication between the seal chambers, but inhibits the downward movement of well fluid. The motor chamber 13 is in fluid communication with the lubricant in the seal section 17, and for purposes herein, the seal section will be considered as part of the motor chamber 13.

Figure 2:
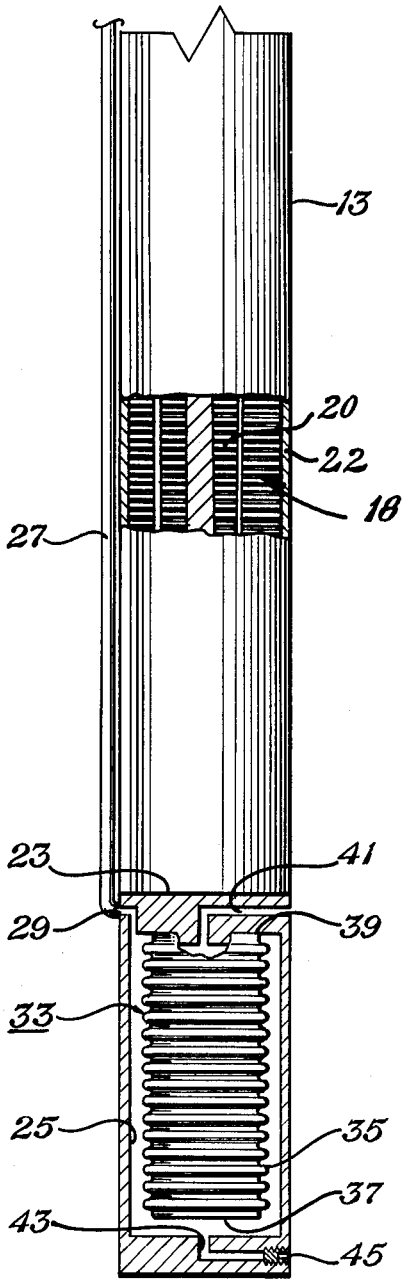
FIG. 2 is a side view, partially in section, of the lower portion of the submersible pump assembly of FIG. 1.

Referring to FIG. 2, a partition 23 is located at the bottom of the motor chamber 13. A pressure compensator chamber 25 is located below partition 23. Partition 23 serves as partition means for preventing downward flow of lubricant from the motor chamber 13 directly into the pressure compensator chamber 25.

A tube 27 has one end secured to a port 29 leading into the pressure compensator chamber 25. Port 29 is located at the top of the pressure compensator chamber 25, directly below partition 23. Tube 27 extends externally of motor chamber 13 and seal section 17. The upper end 31 of tube 27 is secured to a port in the lowest seal chamber 19 of seal section 17. The volume of lubricant in tube 27 is much less than the volume of lubricant that is contained in motor chamber 13. Tube 27 serves as passage means for fluid communicating the seal section 17 with the pressure compensator chamber 25. There is no other passage between pressure compensator chamber 25 and motor chamber 13 other than tube 27.

An expansible container or bellows 33, preferably metal, is mounted in pressure compensator chamber 25. Bellows 33 is generally cup-shaped, or cylindrical, with sidewalls 35 having multiple folds that expand and contract to increase or decrease the volume contained in bellows 33. Bellows 33 has a closed bottom 37 that moves axially to vary the volume and an open mouth 39 that faces upwardly. Mouth 39 is sealingly secured to the bottom of partition 23. A port 41 extends from the exterior of the pressure compensator chamber 25, through partition 23 and leads to the interior of bellows 33. Port 41 serves as port means for communicating the interior of bellows 33 with well fluid. A port 43 located at the bottom of pressure compensator chamber 25 is used for filling lubricant, and while in operation downhole, will contain a plug 45.

Preferably, bellows 33 has balance means for applying a downward force on lubricant in the pressure compensator chamber 25 that substantially equals the force exerted by the lubricant in the seal section 17 and pressure compensator chamber against the exterior of the bellows when the pump is in a static condition under atmospheric pressure. When the pump decelerates suddenly during installation, the liquid in bellows 33 tends to extend the bellows depending upon the rate of deceleration, the mass of the liquid inside the bellows, and the mass of the bellows. At the same time the lubricant in the seal section 17 above the upper end 31 of tube 27 will exert a downward force that is transmitted through tube 27 and the lubricant in pressure compensator chamber 25 to the exterior of bellows 33. The latter force, which depends upon the rate of deceleration and the mass of liquid in tube 27 and in seal section 17 above upper end 31, counters the extending force due to liquid in bellows 33 and tends to contract bellows 33.

If the mass of the lubricant in tube 27 and in seal section 17 above upper end 31 equals the mass of the liquid filled bellows 33, then during deceleration, the forces will equal each other and the bellows will neither expand nor contract. Without contraction of bellows 33, there will be no downward movement of lubricant in tube 27, avoiding any chance of negative pressure at the top seals 21. If the mass of the liquid filled bellows 33 is less than the mass of lubricant inside seal section 17 above tube upper end 31, then some downward flow of lubricant may occur, depending upon the flow restriction or impedance imposed by the diameter of tube 27 and port 41. If the mass of the liquid filled bellows is greater, some positive pressure increase will occur in motor chamber 13. Some pressure differential across the top seal 21 is tolerable, preferably less than 20 psi (pounds per square inch). Since the sizes of tube 27, port 29 and port 41 also affect the amount of pressure differential across top seal 21 created by deceleration, it is not necessary that the mass of the liquid inside bellows 33 exactly equals the mass of the liquid above tube upper end 31.

There are several ways in which the masses, which can be considered herein as weights, can be equalized. One way would be to size bellows 33 and position tube upper end 31 so that the weight of lubricant above upper end 31 and in tube 27 equals the weight of an amount of well fluid to be placed in bellows prior to entering the well. For example, assume that tube 27 and the seal section 17 above upper end 31 as positioned hold one gallon of lubricant having a specific gravity of 0.87, weighing 7.2 pounds. To provide balance, 7.2 pounds of a counterbalancing liquid such as water less the weight of bellows 33 (normally negligible) could be placed in bellows 33 prior to introducing the lubricant into the motor chamber 13. Since the water has a specific gravity of about 1.00, and a weight of about 7.8 pounds per gallon, approximately 0.94 gallons is needed. In the alternative, a weight could be fixed to bellows 33 to cause the total bellows weight to equal 7.2 pounds. In that case, no liquid need be in bellows 33 prior to entering the well.

In another alternative, tube 27 could be removed entirely, with a passage leading from motor chamber 13 directly through partition 23 to pressure compensator chamber 25. A typical motor chamber 13 holds about 10 gallons of lubricant weighing about 72.2 pounds. A suitable bellows 33 holds about two gallons. The forces can be counterbalanced by filling the bellows 33 with about one gallon of a liquid having a specific gravity of 9.3, which equals 72.2 lbs. over the weight of one gallon of water, about 7.8 pounds. Or, a liquid less heavy, but still heavier than well fluid plus weights secured to bellows 33 might be used. The well fluid specific gravity is approximately 1.00.

It is not desirable to completely fill the bellows 33 with a counterbalancing liquid, since counterbalancing liquid reduces the total volume provided for lubricant. Prior to entering the well, there should be a reasonable amount of lubricant in the pressure compensator chamber 25 for replenishment should leakage of lubricant occur in the motor chamber 13. Also, bellows 33 should not be completely collapsed prior to entering the well, since thermal expansion of the lubricant must be accommodated through contraction of bellows 33.

To prepare the pump assembly for installation, lubricant is introduced into the pressure compensator chamber 25, motor chamber 13, and seal section 17. Normally, a vacuum filling technique is used, with lubricant being introduced through port 43, and the vacuum being drawn at the top. In the embodiment shown, motor chamber 13 also has a filling port (not shown) near its bottom for drawing in lubricant. A reservoir of lubricant is connected to these lower ports. The reservoir has a valve that will initially be closed.

In filling, first a vacuum is drawn, removing air from motor chamber 13 and pressure compensator chamber 25, with the valve to the lubricant reservoir closed. This will cause bellows 33 to extend its full length. If a counterbalancing liquid is to be used, it is introduced into bellows 33 either before and after the vacuum is drawn. Then the valve to the lubricant reservoir is opened, while the vacuum pump continues to operate. Lubricant is drawn in to fill the motor chamber 13 and pressure compensator chamber 25. Once completely filled, the vacuum pump is turned off and the ports are closed, with the interior pressure being atmospheric due to open port 41.

If a counterbalancing liquid is used, the force exerted by the counterbalancing liquid in bellows 33 against the lubricant in pressure compensator chamber 25 should equal the force exerted by the weight of the lubricant in seal section 17 above tube upper end 31 and in tube 27 while in a static condition prior to entering the well.

If a counterbalancing liquid is not used, a stop or spring (not shown) within bellows 33 prevents the lubricant pressure from completely collapsing bellows 33 prior to entry into the well. If tube 27 is substituted for a direct passage into the bottom of motor chamber 13, then all of the lubricant can be drawn in through port 43. The counterbalancing fluid should be equal in weight to the weight of lubricant in motor chamber 13.

The pump assembly is then lowered into the well, with port 41 remaining open. The bellows 33 serves as pressure compensating means for reducing pressure differential between the lubricant and the well fluid. Hydrostatic pressure of the well fluid will act against the bellows 33, to cause its sidewalls 35 to extend downwardly, moving bottom 37 along the longitudinal axis of the bellows. This increases the pressure in the pressure compensator chamber 25, this pressure being transmitted to the seal section 17 and motor chamber 13.

If the pump assembly is suddenly stopped or jerked, the lubricant in the motor chamber 13 below tube upper end 31 would not move downward because of partition 23. The lubricant in the tube 27 and in seal section 17 above tube upper end 31 would tend to move downward, which is countered by downward movement of the bellows due to the momentum of the fluid in the bellows. Since the bellows will likely have a greater mass of fluid, a positive pressure will be exerted in chamber 25, tube 27 and motor chamber 13. The diameters of tube 27 and port 41 also retard fluid movement. This prevents a large volume of lubricant from being displaced downward from the top of the seal section 17, thus avoiding negative pressure across the seal 21 of the uppermost seal chamber 19.

Once the pump assembly is located at its proper depth, bellows 33 will expand and contract to accommodate thermal expansion of the lubricant in the motor chamber, and to accommodate other pressure differentials between motor chamber 13 and the well bore. Eventually, any counterbalancing liquid in the bellows 33 that is heavier than well fluid may be displaced entirely by well fluid.

The invention has significant advantages. The communication tube reduces the chances for damaging negative pressure differential to occur during a sudden stop while lowering the assembly. Mounting the bellows such that well fluid is located on the inside of the bellows requires the bellows to be contracted during sudden deceleration, rather than expanded, thus restricting flow of lubricant downward and reducing the chances for negative pressure at the top of the seal section. Retarding this downward movement is also accomplished by the use of a counterbalancing liquid, which is normally heavier than well fluid.

While the invention has been shown in only one of its forms, it should be apparent to skilled in the art that it is not so limited but is susceptible to various changes without departing from the spirit of the invention.

I claim:

1. A method of installing in a well a submersible pump assembly of the type having an electric motor contained within a lubricant filled motor chamber below a pump, comprising:

providing a pressure compensator chamber below the motor chamber;

providing a passage between the pressure compensator chamber and a communication port in the motor chamber;

mounting in the pressure compensator chamber an expansible container having an interior sealed from lubricant in the pressure compensator chamber;

providing a port from the exterior of the pressure compensator chamber to the interior of the container;

placing into the container a liquid of specific gravity greater than the specific gravity of the lubricant and selected to provide a total weight for the container that substantially equals the weight of the lubricant in the motor chamber above the communication port; then lowering the pump assembly into the well.

2. A method of installing in a well a submersible pump assembly of the type having an electric motor contained within a lubricant filled chamber below a pump, comprising in combination:

providing a pressure compensator chamber below the motor chamber and sealed from the bottom of the motor chamber;

mounting in the pressure compensator chamber a pressure compensator that divides the pressure compensator chamber into a borehole fluid section and a lubricant section, the pressure compensator being of a type that is movable to equalize pressure differential across the pressure compensator;

providing a passage between the lubricant section and a communication port in the motor chamber above the bottom of the motor;

providing a passage between the borehole fluid section and the exterior of the pressure compensator chamber;

introducing lubricant into the motor chamber and the lubricant section;

introducing into the borehole fluid section a liquid of specific gravity greater than the specific gravity of the lubricant and the borehole fluid and selected to provide a total weight that substantially equals the weight of the lubricant in the motor chamber above the communication port; then lowering the pump assembly into the well.

* * * * *